United States Patent [19]

Dykes et al.

[11] Patent Number: 4,903,774

[45] Date of Patent: Feb. 27, 1990

[54] ANNULUS SHUT-OFF MECHANISM

[75] Inventors: Christopher E. Dykes, Aberdeen, Scotland; Peter W. Francis, London, England; Hans P. Hopper, Aberdeen, Scotland

[73] Assignee: The British Petroleum Company p.l.c., London, England

[21] Appl. No.: 297,737

[22] Filed: Jan. 17, 1989

[30] Foreign Application Priority Data

Jan. 28, 1988 [GB] United Kingdom ..... 8801850

[51] Int. Cl.[4] ..... E21B 33/043

[52] U.S. Cl. ..... 166/363; 166/368; 166/321

[58] Field of Search ..... 166/363, 368, 373, 374, 166/375, 382, 386, 208, 321, 238

[56] References Cited

U.S. PATENT DOCUMENTS 4,442,902 4/1984 Dorémus et al. ..... 166/375 X 4,691,779 9/1987 McMahan et al. ..... 166/321

4,749,047 6/1988 Taylor ..... 166/382

*Primary Examiner*—William P. Neuder

*Attorney, Agent, or Firm*—David J. Untener; L. W. Evans

[57] ABSTRACT

An annulus shut-off mechanism with fail-as-is logic suitable for use for example, in a concentric tubing hanger of an oil well, particularly a sub-sea well, has an enclosure across the annulus with inlet and exit ports, a sleeve with an aperture that slides within the enclosure, primary means for sliding the sleeve in the enclosure to bring the aperture into alignment with the inlet and exit ports and secondary means for sliding the sleeve in the event of failure of the primary means. The primary enclosure and sleeve are sealed from access to annulus fluids and may be vertically orientated in the tubing hanger. The secondary means may be a secondary enclosure with a secondary sleeve which can pull or push on the primary sleeve. Both primary and secondary means can be operated by hydraulic pressure, but the two means are independent and the secondary means may be located in a well part other than the tubing hanger.

12 Claims, 5 Drawing Sheets

ANNULUS SHUT-OFF MECHANISM

This invention relates to an annulus shut-off mechanism suitable for use for example in a concentric tubing hanger of an oil well, particularly a sub-sea well. The invention will be described with reference to its use in a tubing hanger, but it is to be understood that it is suitable for shutting off any annulus passage in any part of an oil or gas well.

As is well known, sub-sea wells normally have two strings of tubing extending down the well with one down to the producing formation. One set is the production string; the other is referred to as the annulus string, and can be used for a variety of purposes, e.g. artificial lift, fluid injection or, in a work over, the injection of mud to kill the well.

The strings are suspended from a tubing hanger in the well head, the hanger transferring the weight of the strings to the well head conductor and foundation.

The tubing hanger gives access to the production string and to the annulus. It may also, particularly in the case of sub-sea wells, provide suitable hydraulic and/or electrical conduits for the operation of sub-surface safety valves and pressure/temperature transducers. The tubing hanger will incorporate a lockdown mechanism (to prevent lift-off from pressure applied from below) and a pressure seal between the hanger and well head body to make it fluid-tight.

Access through the tubing hanger to the annulus is required to 1. allow either periodical measurement of continuous monitoring of annulus pressures.
2. provide a conduit to bleed down abnormal pressures (e.g. resulting from thermal effects as a well is brought initially to maximum rate).
3. provide a circulation path to kill the well in a work over.
4. allow testing of the seals between the casing and the tubing hanger or tubing.
5. allow the passage of lift fluids or other operational fluids (e.g. completion fluids).

There are two potential flow paths through a tubing hanger (i.e. to the production and annulus strings) and it is necessary to close off both these flowpaths prior to removing either the drilling blow-out preventer or the tree (well head production valve block).

There are two basic types of tubing hanger used for sub-sea well completions.

A. DUAL BORE

This type has two parallel vertical bores for production and annulus respectively. These bores may be isolated by the installation of wire-line plugs.

The majority of sub-sea completions have used dual bore tubing hangers because of the safety factor in being able to set wireline plugs in each bore.

The drawback of dual bore tubing hangers is the need to orientate the hanger precisely within the well head body (as this orientation fixes that of the production valve block and associated pipework). Dual bores also require dual access strings, dual wireline blow out preventers, dual risers and so forth, which themselves require orientation to match to the appropriate bores.

Some functions require precise alignment and orientation, and as more and more functions are added so the problems multiply. Some help with orientation can be obtained if the assembly is at a depth allowing the use of guide posts and guide wires, but with a guide line less system even this fairly coarse assistance is not available.

The problems associated with the orientation of dual bore tubing hangers has led some companies to consider and use

B. CONCENTRIC BORE

Rather than two parallel bores, the concentric bore tubing hanger has, as its name implies, concentric flow paths an inner bore being typically the production flow path and the outer being a concentric, annular path. Being concentric, a concentric bore tubing hanger can be installed without consideration of orientation.

The production bore can be plugged using a wireline plug as for a dual bore, but there is no practicable way of plugging the annulus to isolate it. The annulus has to be isolated by some form of independent valve. One technique is to incorporate a check valve which is pulled to the closed position on retrieving the tree. An alternative design uses a sliding sleeve valve or a poppet valve that can be moved hydraulically, with a fail safe closing spring.

Despite the advantages of a concentric tubing hanger, some companies have been reluctant to use it sub-sea, believing existing annulus shut-off valves and mechanisms not to be sufficiently safe and reliable in the long term.

The present invention is concerned with an improved annular shut-off mechanism. Its use should, it is believed, allow concentric tubing hangers to be used sub-sea with increased safety leading to the following benefits, particularly in deep water locations.

1. As previously stated, the need for precise orientation of the hanger is eliminated, as is the requirement for a drilling connector upper body unit with an orientating reference slot or pin, or a guide pin in the BOP stack.
2. There is no annulus wireline work so that no vertical access to the annulus is necessary. This simplifies the use of dual workover strings if used instead of a concentric one and simplifies the wireline blow-out preventer and well tree design.
3. Larger tubing bores can be accommodated, without loss of annular area, in any given casing size than is the case with dual bore designs. Up to 7 inch diameter water injection pipes are potentially possible.
4. Concentric, non-orientating conductive couplers can be used to transmit electrical power to down hole instruments and monitors.
5. Sufficient concentric space is available to allow the potential use of larger conductive couplings to power electrical equipment and instrumentation gauges.
6. The requirement for short annulus strings is eliminated. Short strings can prejudice effective well control across the BOP when the completion is being run.

The improved annulus shut off mechanism of the present invention uses a fail-as-is logic and has a secondary back-up system. It is to be considered as a replacement for the wireline plug and not as a working master valve.

According to the present invention an annulus shut-off mechanism with fail-as-is logic suitable for use in the annulus of a concentric bore tubing hanger of an oil well comprises:

an enclosure across the annulus having inlet and exit ports, a sleeve, capable of sliding in the enclosure, having an aperture capable of aligning with the inlet and exit ports, primary means for sliding the sleeve to the open or closed position, and secondary means independent of the primary means, for sliding the sleeve in the event of failure of the primary means.

The fail-as-is logic, with secondary back-up, of the mechanism of the present invention is considered to have advantages over other logics.

Fail-safe-open is not appropriate, as the mechanism could fail open when the well tree was removed. A fail-safe-closed mechanism would mean that control of the annulus could be lost during normal production and would be unsafe in the event of failure and a requirement for a workover. Further, some fail-safe-closed mechanisms rely on a spring for closure, and failure of the spring could be dangerous.

The enclosure and sleeve are enclosed within the tubing hanger so that the mechanism cannot be adversely affected by fluids or solids within the well casing, including annulus fluids. Some annulus shut off valves are exposed to annulus fluids and use annulus pressure to assist closing. Not only does such exposure increase the risk of corrosion; it also means that the valves require a higher operating pressure, which may be as high as the annulus pressure. An enclosed shut-off mechanism avoids such drawbacks.

The primary means for sliding the sleeve is preferably hydraulic fluid fed to either end of the enclosure, the sleeve acting as a double-ended piston within the enclosure. The enclosure and sleeve will normally be oriented vertically in the hanger and preferably the up position of the sleeve is the closed position.

The hydraulic primary operating system may be controlled by the remote (e.g. surface) production unit controlling the well. The lines can be pressured to the same pressure as that of any surface-controlled sub-sea safety valves (e.g. up to 10,000 psig) for either primary open or primary closed. Such a high pressure may be required to ensure that the sleeve which hydraulics have a positive pressure over the annulus pressure in the unlikely event of leaking seals. Normally 1500 psig should be adequate. The upper and lower sealing cross-sections of the sleeve which are exposed to and effected by the annulus pressure are preferably equal so that the sleeve is pressure balanced and independent of the annulus pressure. This allows a lower hydraulic pressure to be used below that of the annulus pressure.

The secondary means for sliding the sleeve should, obviously, be separate from, and independent of, the primary means. It could be mechanically operated but it is preferably also hydraulically operated. The hydraulic pressure may, however, be lower than that of the primary means (e.g. 1500 psig for secondary open and secondary closed).

The secondary means may be a secondary enclosure and sleeve, the secondary sleeve being capable of pulling or pushing the primary sleeve. The mechanical link between the primary and secondary sleeves may be a multi-fingered latch, which may be referred to as of the "fish hook" type.

A latch of this type enables the secondary system to be, under normal operation, disconnected from the primary system so that the primary system can be operated without interference from the secondary system. In the event of failure of the primary system, however, the latch may be actuated to pull the primary sleeve or to push it, depending on whether the primary sleeve has failed open or closed.

The use of a disconnectable secondary system has a number of advantages over the alternative approach of applying secondary hydraulic pressure directly against the primary sleeve, viz.

1. The secondary sleeve and latch can be located in a part separate from the tubing hanger, e.g. in a tree connector stinger. This means that the secondary enclosure can be charged with clean hydraulic fluid on the sea suface before running the connector stinger. The primary system in the tubing hanger has, perforce, to be exposed to well bore contamination when the installation/retrieval tool is removed and the BOP is pulled.
2. Given that the secondary hydraulic conduits are integral with the connector stinger, this reduces by two (secondary open or close) the number of functions which are isolated by the mating of the connector stinger and tubing hanger.
3. Wear on the secondary sleeve seals is minimal and the secondary system can be kept in reserve in good order.
4. Failure of the secondary sleeve does not interfere with the operation of the primary system and it can be recovered and overhauled without needing to recover the entire completion.

Associated with the secondary system may be a position monitor giving an indication of the position of the secondary sleeve. This monitor may be a spring loaded pin which may indicate position either hydraulically (e.g. by shutting off a hydraulic monitoring flow line to a check valve and test cavity) or electrically (e.g. by actuating a linear variable differential transformer sensor).

The invention is illustrated with reference to the accompanying drawings in which.

FIG. 3B is an enlargement of part of FIG. 3A showing the annulus shut-off mechanism, and.

Figure 1:
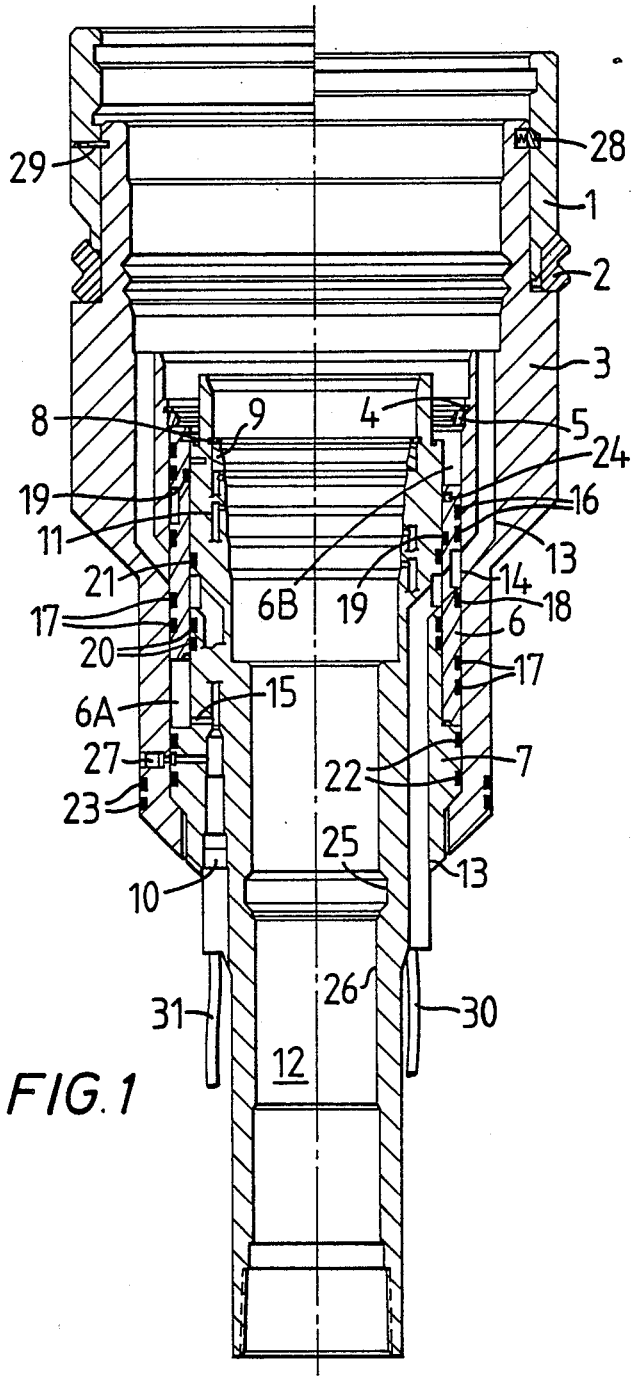
FIG. 1 is a section through a concentric tubing hanger having an annulus shut-off primary mechanism according to the present invention.

In FIG. 1, a concentric tubing hanger is formed of a lock down sleeve 1, a split locking ring 2, and a main housing 3; inside the main housing 3 is a retaining ring 4 for a latch/unlatch ring 5 which can disconnect the secondary latch system. Sleeve 6 for an annulus shut off mechanism is positioned between the main housing 3 and an inner body 7, being enclosed between the two.

Although not forming part of the present invention, there is provision within the tubing hanger for a coupling for electrical power supply and electrical signals supply to downhole instruments, this being formed of an electrical outer ring 9 held in place by latch ring 8, electrical conduit 11 and an electrical penetrator 10. The coupling may conveniently be of the type described and claimed in UK Patent Application No. 2180107.

The central bore 12 of the hanger forms the production bore, and has a wireline plug profile 25, with sealing area 26. From the annulus surrounding this bore, passageways 13 extend up through the hanger to form the annulus flow system. Sleeve 6 is positioned across this passageway, enclosed between the main housing 3 and inner body 7. Cables 30, 31 connect two sub-surface control valves to ports in the connector stinger (38 and 39 of FIG. 2). Cables 30, 31 are not part of the annulus flow system, being positioned radially in the hanger away from the passageways 13.

FIG. 1 is a composite drawing, the left hand side showing sleeve 6 in the closed (up) position, and the right hand side showing sleeve 6 the open (down) position. The left hand side of the drawing shows how the bottom end of sleeve 6 closes passageway 13 when the sleeve is up and the right hand side of the drawing how aperture 14 through sleeve 6 lines up with the passageway when the sleeve is down. Aperture 14 of sleeve 6 is angled at an angle preferably at 45° to the sleeve to minimise the change of direction of annulus fluids as they pass up or down passageway 13 through aperture 14.

The sleeve 6 is moved up or down by a primary source of hydraulic power. Hydraulic fluid may be passed to the space 6A below sleeve 6 through hydraulic line 15 and to the space 6B above sleeve 6 through a corresponding hydraulic line (not shown). Space 6B is closed and rendered fluid tight when the connector stinger of FIG. 2 (see FIG. 3B) or the installation and retrieval tool is locked on top.

There are seals in sleeve 6 and inner body 7 to ensure that there is no leakage of annulus fluid from passageway 13 or of the hydraulic fluid powering the sleeve. Double elastomeric ring seals are shown at 16 and 17 at the top and bottom of sleeve 6 and a single ring seal 18 just below aperture 14. These seal the sleeve as it slides relative to main housing 3. There is also a single seal 19 on sleeve 6 and a double seal 20 and single seal 21 on inner body 7 thus sealing the sleeve as it slides relative to inner body 7. Double elastomeric seals are used, where appropriate, throughout the design to allow for different service requirements. One seal is for chemical resistance; the other for explosive decompression.

Also shown in FIG. 1 are seals 22 between main housing 3 and inner body 7 to seal these parts on either side of a flow path 27, which may provide an outlet for dielectric fluid used for flushing the electrical coupling previously mentioned. There is also a double seal 23 on the outside of main housing 3 to seal the tubing hanger into the well head.

The top of sleeve 6 has latch grooves 24 which form part of the arrangement for latching the secondary system (described in FIG. 2) to the primary sleeve 6.

At the top of the tubing hanger is a spring loaded shear pin 28 for retaining the lock down sleeve 1 in main housing 3 when locked into the well head and a shear pin 29 to hold the parts while the system is being run. On landing the hanger sufficient force is extended by a hydraulic piston in the installation and retrieval tool which shears pin 29 and moves sleeve 1 down, locking the hanger into the well head as shown on the right hand side of the drawing.

Figure 2:
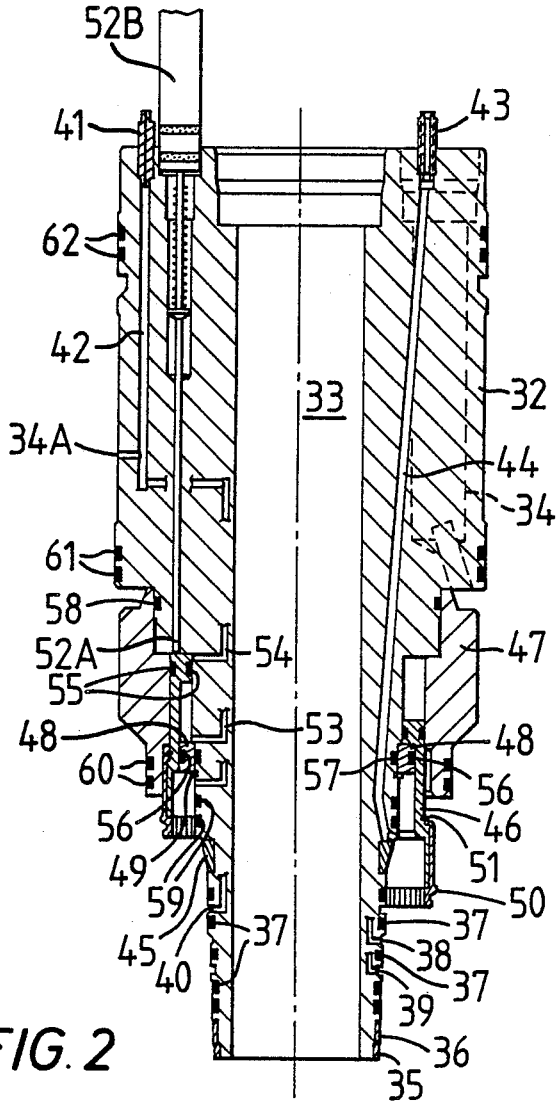
FIG. 2 is a section through a connector stinger assembly having a secondary system according to the present invention.

FIG. 2 shows a connector stinger with a secondary system according to the present invention. Connector stingers are standard pieces of equipment of well heads fitting within the tubing hanger and serving, as the name implies, to connect the tubing hanger and the production and annulus bores to the well head connector itself and the well tree.

Thus the connector stinger of FIG. 2 has a main body 32 up through which passes the central production bore 33 and the annulus bore 34 (shown by dotted lines). At the bottom of main body 32 is a metal lip seal 35 and seal retainer 36 which seal the stinger against the inside of the tubing hanger. There are a number of elastomeric seals 37 above the metal seal, also serving to seal the stinger and tubing hanger, particularly on either side of hydraulic flow lines 38, 39 and 40 which feed hydraulic fluid to the tubing hanger and the primary enclosure and sleeve of the tubing hanger. These flow lines may be used for operating sub-surface control valves and the annulus shut-off mechanism.

The left hand side of the stinger shows a typical seal mandrel 41, and hydraulic line 42. There may be a number of such mandrels and lines drilled around the stinger to supply hydraulic power to the primary and secondary parts of the annulus shut-off mechanism and to sub-surface control valves. One of lines 42 is shown with a side outlet 34A which can be used for testing the well head gasket. There is also a mandrel 43 and line 44 carrying wires and supplying dielectric fluid to an electrical coupling 45.

Electrical contact rings of coupling 45 are supplied by wires through line 44 and are positioned to mate with electrical contact rings of coupling 9 of the tubing hanger (FIG. 1) to provide a conductive electrical flow path into the tubing hanger and well itself.

The secondary system of the present invention has a secondary sleeve 46 capable of sliding within an enclosure formed by the stinger main body 32, collar 47 and stop ring 48, which is held in place by circlip 49. Sleeve 46 extends downwardly to end in a series of finger latches 50 which are retained by ring 51. A sleeve position indicator 52A contacts sleeve 46 at one point. This indicator 52A is in the form of a spring loaded rod leading up to a linear variable differential transformer sensor 52B.

As with FIG. 1, FIG. 2 is a composite figure, the left hand side showing sleeve 46 in the disconnected (up) position and the right hand side showing sleeve 46 in the connected (down) position. The sleeve can be moved up or down by the application of hydraulic pressure through line 53 to below the sleeve or through line 54 to above the sleeve.

Seals 55 on either side of sleeve 46 seal it against its sliding contact with main body 32 and collar 47. There is also a seal 56 in stop ring 48. These are seals 57 and 58 where stop ring 48 and collar 47 contacts the main body. Finally there are sets of double seals at 59, 60, 61 and 62 sealing the stinger against the mating parts of the tubing hanger.

Figure 3A:
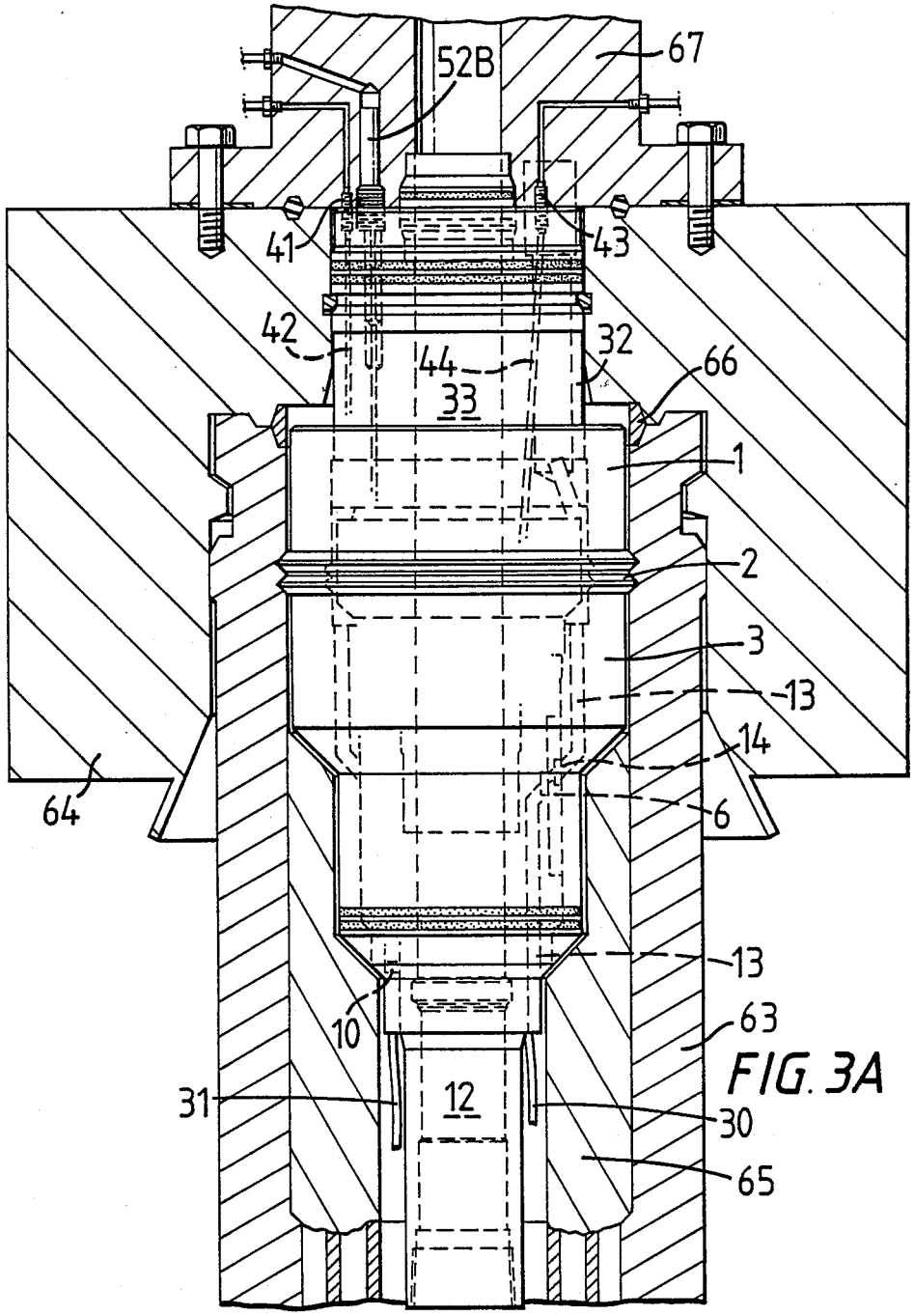
FIG. 3A is a section through a completed well head with a concentric tubing hanger and a connector stinger.
Figure 3B:
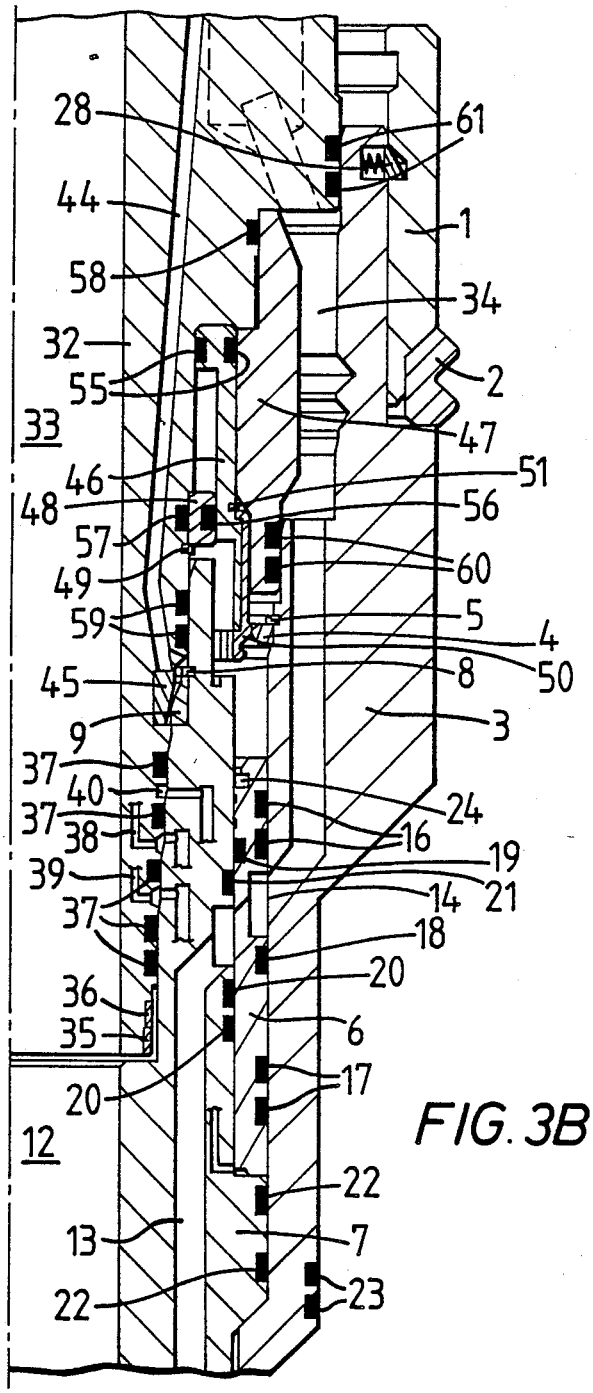

FIG. 3A shows a well head with the tubing hanger of FIG. 1 and the connector stinger of FIG. 2 in their mated positions. FIG. 3B is an enlargement of part of FIG. 3A showing more clearly the primary and secondary systems and their relationship.

The same numerals are used in FIGS. 3A and 3B to indicate the main parts of the shut-off mechanism as have been used in FIGS. 1 and 2. FIGS. 3A and 3B show how the tubing hanger and stinger combine to form a sealed, enclosure system for the primary and secondary sleeves of the shut-off mechanism.

FIG. 3A also shows how the tubing hanger and stinger relate to the other well head components. Tubing hanger main housing 3 is thus shown within well head housing 63, which, in its turn, has a production connector 64 latched to it. Also shown are the casing hangers and pack offs 65. The well head gasket for the housing is indicated at 66 and the base of a tree valve block at 67.

In operation, the tubing hanger and connector stingers will be landed and installed separately with both the primary and secondary sleeves in their up positions (i.e. closed and disconnected respectively). To bring the annulus into use, primary sleeve 6 is moved down by hydraulic pressure applied to its top 6B, the hydraulic space 6A below the sleeve being vented to return in the control unit. The secondary sleeve and system remain disconnected because no hydraulic pressure is applied to the secondary system.

Reversing the primary hydraulic pressure flow of the primary system will move the sleeve up again to close the annulus. In the event of failure of the primary hydraulic system, sleeve 6 will remain in its position, there being no springs or other mechanisms acting on it to change its position. Failure could result from seal failure or external line failure from the tree control pod.

If the primary system has failed with sleeve 6 in its down (open) position, or in any other position than its fully closed (up) position, the secondary system can be hydraulically pressurised and by applying pressure to the top of secondary sleeve 46 (and venting the space below) sleeve 46 is moved down until finger latches 50 of the secondary sleeve 46 engage with latch grooves 24 of the primary sleeve. Reversing the hydraulic pressure in the secondary system will raise both secondary and primary sleeves together, thereby closing the annulus. When the secondary sleeve has reached the end of its upward stroke, it makes contact with ring 5 within space 6B disconnecting the finger latches 50 from the latch grooves 24 and thus disconnecting the primary and secondary sleeves again. Contact with ring 5 depresses the fingers inwards thus disconnecting them from the latch groove 24.

If the primary system has failed with sleeve 6 in its up (closed) position, the annulus may be opened by pressurising the secondary system with pressure to the top of secondary sleeve 46. Secondary sleeve 46 will move down, forcing the primary sleeve down, until the annulus is opened.

Position indicator rod 52A follows sleeve 46, as previously indicated and simulates, a linear variable differential transformer sensor 52B to give an electrical signal indicative of the portion of secondary sleeve 46 (and of primary sleeve 6 if the secondary system is being used to move the primary sleeve 6).

Figure 4A:
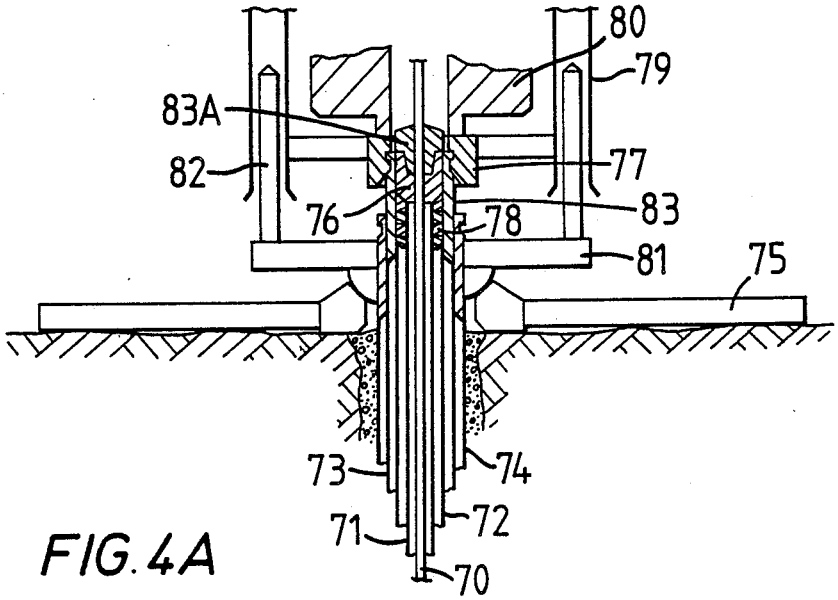
FIGS. 4A and 4B are sections through a sub-sea well assembly in, respectively, the drilling and production modes.
Figure 4B:
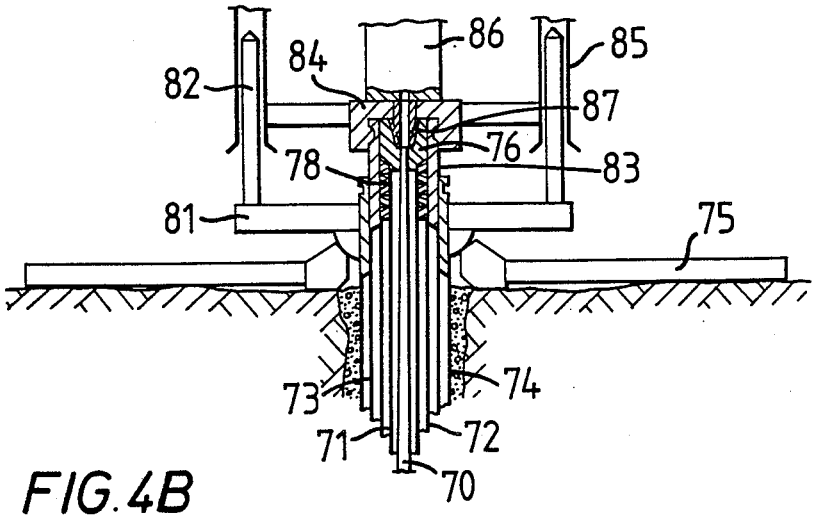

FIGS. 4A and 4B show the concentric tubing hanger of the present invention and its positioning in relation to a sub-sea well. In both Figures, a well is shown with production tubing 70, three casing strings 71, 72, 73 and outer conductor casing 74. The well is drilled through a temporary guide base or mud mat 75. In FIG. 4A a concentric tubing hanger 76 according to the present invention is shown installed within a well head housing 83, with a BOP drilling connector 77 latched to it, and with casing hanger and pack offs 78 below the well head. Connector 77 supports a BOP frame 79 and BOP 80, this frame being located on a permanent guide base 81 with guide posts 82.

FIG. 4A shows the assembly in drilling mode. The concentric tubing hanger is run and landed using an installation and retrieval tool 83. This tool may be of any convenient form capable of releasably latching onto the tubing hanger, and capable of implementing the landing and locking operations and as its name implies, may be used both for installing the hanger and for retrieving it, if required.

FIG. 4B shows the assembly in production mode. The well head housing 83, concentric tubing hanger 76, casing hanger 78 and permanent guide base 81 remain but the drilling connector 77 has been replaced by a production tree connector 84 supporting tree frame 85 and tree block 86. Concentric tubing hanger stinger 87 provides the link and pathway between the hanger 76 and tree block 86.

I claim:

1. An annulus shut-off mechanism with fail-as-is logic suitable for use in the annulus of a concentric bore tubing hanger of an oil well comprising:

an enclosure across the annulus sealed from access to annulus fluids having inlet and exit ports, a sleeve, capable of sliding in the enclosure, having an aperture capable of aligning with the inlet and exit ports, primary means for sliding the sleeve to the open or closed position, and secondary means independent of the primary means, for sliding the sleeve in the event of failure of the primary means.

2. An annulus shut-off mechanism as claimed in claim 1 wherein the primary means for sliding the sleeve is hydraulic pressure supplied to the enclosure at either end of the enclosure.

3. An annulus shut-off mechanism as claimed in claim 1, wherein the enclsoure and sleeve are oriented vertically in the hanger and the up position of the sleeve is the closed position.

4. An annulus shut-off mechanism as claimed in claim 3, wherein the inlet and exit ports of the enclosure are at different vertical levels and the aperture through the sleeve is at an angle to the horizontal.

5. An annulus shut-off mechanism as claimed in claim 1 which is pressure balanced with respect to the annulus pressure.

6. An annulus shut-off mechanism as claimed in claim 1 wherein the secondary means for sliding the sleeve is a secondary sleeve within a secondary enclosure, said secondary sleeve being capable of pulling or pushing the primary sleeve.

7. An annulus shut-off mechanism as claimed in claim 6 wherein the secondary sleeve is detached from the primary sleeve during normal operation.

8. An annulus shut-off mechanism as claimed in claim 6 wherein the primary sleeve and enclosure are located in a tubing hanger and the secondary sleeve and enclosure are located in a well part other than the concentric tubing hanger.

9. An annulus shut-off mechanism as claimed in claim 8 wherein the secondary sleeve and enclosure is located in a tree connector stinger of the well.

10. An annulus shut-off mechanism as claimed in claim 6 wherein the secondary sleeve has a multi-fingered latch capable of engaging with a corresponding groove of the primary sleeve.

11. An annulus shut-off mechanism as claimed in claim 6 wherein the secondary sleeve is operated by hydraulic pressure independent of the hydraulic pressure of the primary means.

12. An annulus shut-off mechanism as claimed in claim 6 wherein the secondary sleeve has a position indicator.

* * * * *